United States Patent [19]

Greenawalt

[11] 4,094,629

[45] June 13, 1978

[54] VERTICAL KILN APPARATUS

[75] Inventor: Eddie Lee Greenawalt, Lake Jackson, Tex.

[73] Assignee: The Dow Chemical Company, Midland, Mich.

[21] Appl. No.: 770,861

[22] Filed: Feb. 22, 1977

[51] Int. Cl.[2] ..... F27B 9/14; F27D 3/00

[52] U.S. Cl. ..... 432/98; 214/18 R

[58] Field of Search ..... 432/97, 98; 214/18, 214/18 V

[56] References Cited

U.S. PATENT DOCUMENTS

| | | | |
|---|---|---|---|
| 386,665 | 7/1888 | Solvay | 432/98 |
| 3,423,840 | 1/1969 | Beeken | 432/98 X |
| 3,704,011 | 11/1972 | Hand et al. | 432/98 X |

*Primary Examiner*—John J. Camby
*Attorney, Agent, or Firm*—V. Dean Clausen

[57] ABSTRACT

The apparatus of this invention is a vertical shaft kiln designed for firing aggregate materials. In a specific application the kiln is used to fire limestone aggregate (crushed limestone) to produce lime. The kiln chamber in this apparatus is defined by an annular space between an outer vertical shaft and an inner vertical shaft. An outwardly sloping cone member defines the bottom end of the inner shaft. The bottom end of the outer shaft is defined by an inwardly sloping cone. A space between the cone members provides an outlet for the kiln chamber.

8 Claims, 3 Drawing Figures

VERTICAL KILN APPARATUS

In a typical operation the rock aggregate moves downwardly in the annular chamber through a firing zone. From the chamber the rock falls through the outlet space and collects on a stationary shelf. As the rock collects on the shelf it assumes a normal angle of repose. The "toe" of the rock is then continuously displaced by several moving scraper blades. This changes the normal angle of repose to a steeper angle which allows the rock to slide off the shelf at a controlled, uniform flow rate. The displaced rock is swept into a hopper and falls onto a transport device, such as a conveyor belt, which delivers it to the next point.

BACKGROUND OF THE INVENTION

This invention relates to an improvement in a vertical kiln apparatus. In this apparatus an aggregate material, after being fired in the kiln chamber, flows downwardly onto a shelf below the chamber. The aggregate is continuously displaced from the shelf, in volumetrically equal increments, to induce uniform gravity flow of the aggregate through the kiln.

Vertical kilns are used for various applications, such as firing of limestone aggregate to produce lime. A typical commercially available vertical kiln is a structure having a vertical cylindrical shaft which provides a kiln chamber. Pipes which include flame nozzles are positioned crosswise in the kiln chamber to provide a firing zone. These pipe structures are usually referred to as firing beams.

In the kiln structure described above the firing beams cause a problem which is difficult to overcome. For example, in the manufacture of lime in a vertical kiln the limestone aggregate (crushed limestone) is introduced through the top of the kiln chamber. As the stone falls downwardly in the kiln chamber it passes first through a preheat zone, then through a firing zone, and into a cooling zone at the bottom of the kiln. The firing zone is the middle part of the kiln chamber in which the crosswise firing beams are positioned. The presence of the firing beams disrupts the normal flow of the aggregate, thus causing the aggregate to move at an erratic rate through the firing zone. The result of this erratic flow rate is a variance in the residence time of the aggregate in the firing zone, so that inevitably some of the stone is overburned and some is underburned. It follows, therefore, that to produce a uniformly, high quality aggregate in a shaft kiln, it is essential that the aggregate flow at a controlled, uniform rate through the firing zone.

SUMMARY OF THE INVENTION

The invention is directed to a vertical kiln apparatus useful for firing an aggregate material. The basic apparatus is made up of two upright cylindrical shafts, one shaft being of larger diameter than the other. Each shaft defines a wall which has a bottom end. The larger diameter shaft encloses the smaller diameter shaft, in a concentric relationship. The wall of the larger shaft is spaced from the wall of the smaller shaft to provide an annular kiln chamber between the shaft walls. The annular chamber is adapted to receive and contain an aggregate material during operation of the kiln.

The apparatus includes two cone members, an inner cone and an outer cone. The wall of the inner cone slopes outwardly and downwardly from its top end. The inner cone is joined at its top end to the bottom end of the wall of the smaller shaft. The wall of the outer cone member is sloped inwardly and downwardly from its top end, which is joined to the bottom end of the wall defining the larger diameter shaft. An outlet for the kiln chamber is provided by a space between the bottom end of the outer cone wall and the outside surface of the inner cone wall. A flat plate is fastened along its upper surface to the bottom end of the inner cone wall. The upper surface of this plate extends beyond the inner cone wall to provide a shelf. The shelf is designed to support the aggregate material during downward movement of the aggregate from the kiln chamber.

Above the shelf member is a driven gear which is supported by a support member fastened to the wall of the outer cone. The drive gear is engaged by a driver gear which, in turn, is operatively connected to a drive means. Several blade members are fastened to the driven gear such that each blade is positioned above the shelf. During operation of the kiln the blades more in the same direction as the driven gear and continuously scrape the aggregate material from the shelf. The displaced material falls into a collection means positioned below the shelf.

DESCRIPTION OF A PREFERRED EMBODIMENT

Figure 1:
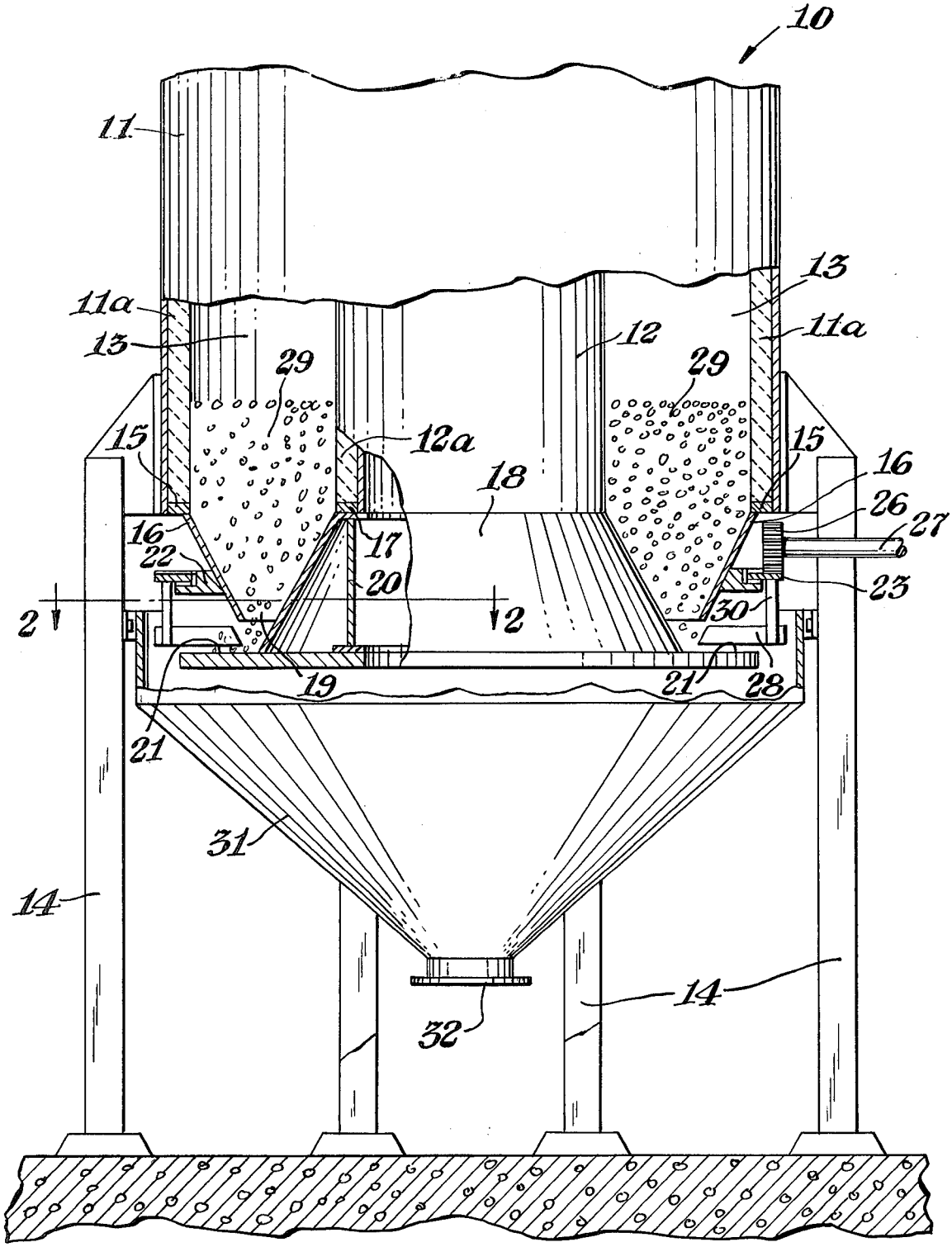
FIG. 1 is a side elevation view, partly in section, of one embodiment of a vertical kiln apparatus according to this invention.

In the drawing, referring particularly to FIG. 1, the numeral 10 generally designates the kiln apparatus of this invention. The basic kiln apparatus is made up of two upright cylindrical shafts 11 and 12. Only the lower part of each shaft is shown in the drawing. Shaft 11 is an outer shaft, of a larger diameter, which encloses the smaller diameter shaft 12. The inner wall surface of shaft 11 is lined with a layer **11*a* of a refractory material. The outer wall surface of shaft 12 is covered with an identical layer of refractory material, indicated by numeral 12*a*. An annular space defined between the refractory layers 11*a* and 12*a* provides a kiln chamber 13**.

The kiln apparatus 10 is supported by several leg members 14. At the top end each leg is fastened into a bracket attached to the outer wall surface of shaft 11. At the bottom end of shaft 11 the inner wall surface of the shaft is adhered to a circular ring member 15. An outer cone member 16 is fastened to the bottom end of shaft 11. More specifically, the wall which defines cone member 16 is joined at its top end to the underside of ring member 15. The wall of cone member 16 slopes inwardly and downwardly from its top end. At the bottom end of shaft 12 a smaller diameter circular ring member 17 is fastened to the outer wall surface. An inner cone member 18 is defined by a wall which is joined at the top end to the underside of the ring member 17. The wall of cone member 18 slopes outwardly and downwardly from its top end.

Figure 2:
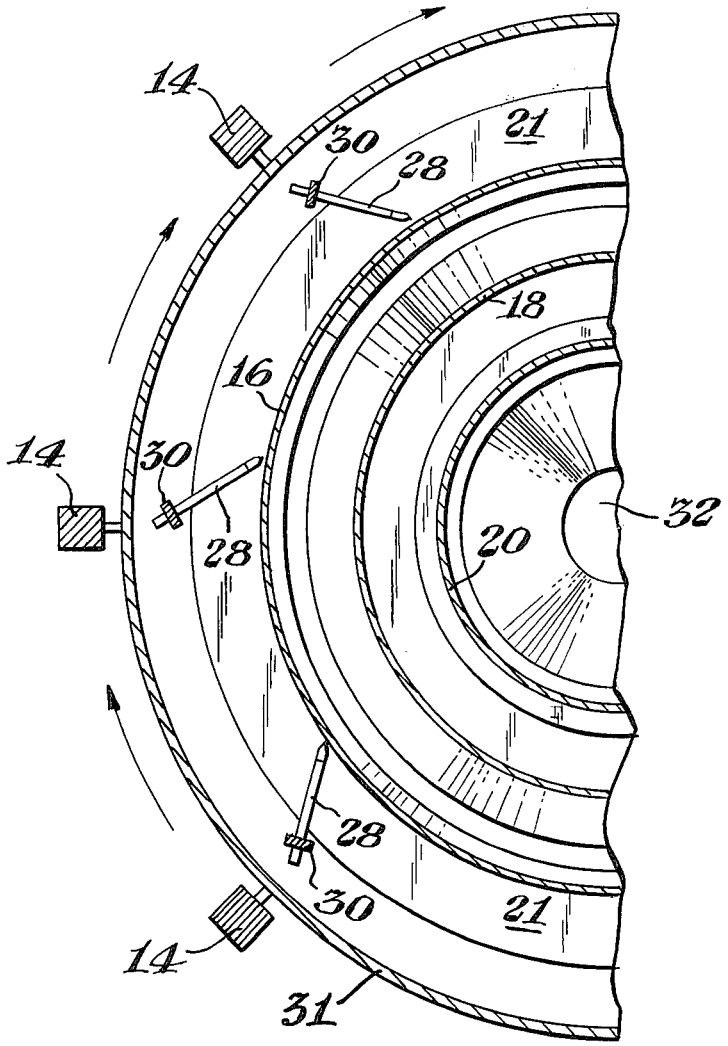
FIG. 2 is a cross section view, taken along line 2—2, of the kiln apparatus of FIG. 1.

The bottom end of the wall which defines cone member 16 is spaced from the wall of cone member 18. This space, as indicated by numeral 19, is an outlet for the kiln chamber 13. A flat circular plate is joined along its upper surface to the bottom edge of the wall which forms the inner cone member 18. This plate is further supported by a vertical ring member 20, which fits between the underside of ring member 17 and the upper surface of the flat plate. As indicated in the drawing, the upper surface of the plate extends beyond the bottom outer edge of the wall which forms the inner cone 18. This extended portion of the plate upper surface provides a shelf 21. The surface which forms shelf 21 is best illustrated in FIG. 2.

Figure 3:
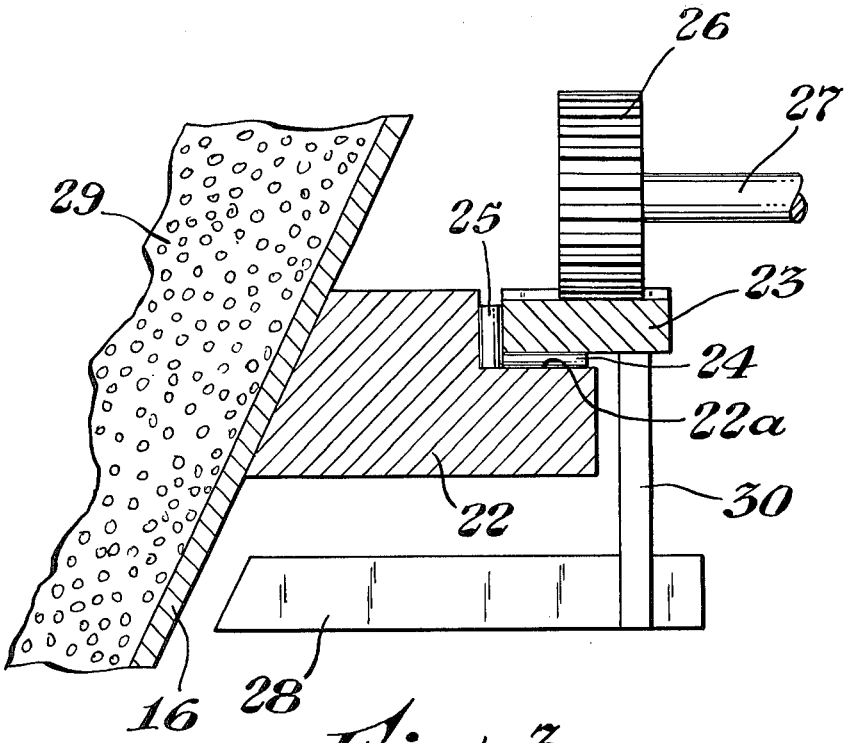
FIG. 3 is an enlarged detail view illustrating a scraper blade component of the kiln apparatus of FIG. 1.

Referring particularly to FIG. 3, a circular support member 22 is fastened to the outer surface of the wall of cone 16 at a point above the bottom edge of the cone wall. A shoulder portion **22*a* is defined at the top edge of support member 22. This shoulder portion is designed to support a ring gear 23. It is preferred to support the gear 23 on a bearing surface as the gear rides around the shoulder 22*a*. A horizontal bearing surface is provided by a set of roller bearings 24. The vertical bearing surface is provided by another set of roller bearings 25**.

The driven gear 23 is rotated by a driver gear 26, which is mounted on one end of a shaft 27. The opposite end of shaft 27 is connected into a suitable drive means, such as an electric motor (not shown). During operation of the kiln 10, the aggregate material 29 in the kiln will collect on shelf 21. Several upright scraper blades 28 provide a means for removing the aggregate material from shelf 21. Each scraper blade 28 is secured to the underside of the ring gear 23 by a leg member 30. The size, shape, and sweep angle of each blade is identical, and the blades are connected at equidistant points around the ring gear, as best illustrated in FIG. 2. The invention is not limited to the precise structure of the scraper blades illustrated and described herein. Any means may be used which will remove the aggregate 29 from shelf 21 in a manner such that uniform flow of the aggregate through the kiln chamber is achieved.

A typical procedure for producing lime in the present kiln apparatus will now be described to illustrate the invention. In this procedure the aggregate material 29 is crushed limestone rock. At the start of the procedure the rock aggregate 29 is loaded into the kiln chamber 13 through the top of the kiln apparatus 10. The top of the kiln is not shown in the drawing. The rock aggregate is loaded evenly so that the height of the material is the same at all points around the top of the kiln chamber.

As the kiln chamber is loaded, the rock aggregate 29 will move downwardly through the outlet 19 and collect on shelf 21. After loading is complete the driven gear 23 is rotated continuously by the driver gear 27 to move the scraper blades 28 in a circular path just above the shelf 21. The rate of rotation is variable, at the operator's discretion. The travel path of the scraper blades may be clockwise, as indicated by the arrows in FIG. 2, or it can be counter clockwise. As the moving blades contact the rock which is resting on shelf 21, each blade removed an equal portion of the "toe" of the rock from the shelf. That portion of the rock which is displaced is swept into a hopper 31 positioned below shelf 21. The rock in the hopper falls through the hopper outlet 32 and onto a conveyor belt or other suitable means for transporting it to the next point. The conveyor means is not illustrated in the drawing.

In the practice of this invention the objective is to move the aggregate material through the kiln chamber at a uniform rate. This is done to avoid overburning the aggregate as it passes through the firing zone in the chamber. The construction and operation of the present kiln makes it possible to achieve the desired uniform flow of aggregate. For example, the annular cross section of kiln chamber 13 provides a relatively narrow space through which the aggregate must move.

In this narrow chamber the effects of "wall friction" on the downwardly moving aggregate are substantially equal at all points in the aggregate mass. The narrow cross section of the kiln chamber also makes it possible to eliminate the firing beams which are required in the prior vertical kilns. Instead of firing beams the firing zone in the present kiln apparatus consists of opposing sets of firing nozzles. One set of nozzles is inset into the refractory layer **11*a*. An identical set of nozzles is installed in refractory layer 12*a*** directly opposite to the first set. These firing nozzles, which are located about the mid point of the kiln chamber, are not illustrated in the drawing.

There are several other features of the present kiln apparatus which enable a uniform flow of the aggregate rock through the kiln chamber. For example, the "toe" of the aggregate 29 can be generally defined as the portion of the aggregate material which lies below the bottom edge of cone wall 16 and which is at rest on shelf 21. While it is in the rest position the aggregate toe portion assumes a normal angle of repose, probably about 45°. At the normal angle of repose the aggregate material will lie at rest without sliding. However, as each moving scraper blade 28 displaces a given portion of the aggregate toe, the normal angle of repose will change.

When the angle of repose changes, the rock above each moving blade will immediately assume a steeper angle. The steeper angle causes the aggregate to slide downwardly. After each blade passes, the aggregate behind the blade will settle by gravity and again assume a normal angle of repose. A good uniform flow of the aggregate through the chamber outlet 19 is also made possible by the steep downward slope of the inner cone wall 18 and the outer cone wall 16. For example, each cone wall has a downward slope of about 30° from perpendicular. Since the slope angle of the cone walls is several degrees steeper than the normal angle of repose, the aggregate passing downwardly through outlet 19 has a good slide angle at all times.

In addition to the advantges described above, the present kiln apparatus has a capability for using less energy than is required by the conventional kilns now in use. For example, the scraper blades are mounted on ring gear 23 such that each blade sets at an angle. The blade angle is relative to the perpendicular axis of shelf 21 and is toward the direction in which the blade travels above the shelf. The preferred set angle for each blade is from about 30° to 50°.

By setting the scraper blades at an angle, much less power is required to push the blades through the aggregate than would be required if the blade faces were pushing flat against the aggregate material. In addition, by setting the scraper blades at an angle, the aggregate ahead of each blade is pushed toward the outer edge of the shelf 21, where it can easily fall into the hopper below the shelf.

The invention claimed is:

1. A vertical kiln apparatus for firing an aggregate material which comprises:

a first upright cylindrical shaft defining a wall which has a bottom end;

a second upright cylindrical shaft defining a wall which has a bottom end;

the second shaft enclosing the first shaft, with the second shaft wall being spaced from the first shaft wall to define an annular kiln chamber between said shaft walls;

the kiln chamber being adapted to receive and contain an aggregate material;

a first cone member having a wall with a top end and a bottom end, the first cone wall sloping outwardly and downwardly from the top end, and the first cone wall being joined at its top end to the bottom end of the first shaft wall;

a second cone member having a wall with a top end and a bottom end, the second cone wall sloping inwardly and downwardly from the top end, and the second cone wall being joined at its top end to the bottom end of the second shaft wall;

the bottom end of the second cone wall being spaced from the first cone wall to define an outlet for the annular kiln chamber;

a plate member fastened along its upper surface to the bottom end of the wall of the first cone member, the upper surface of said plate extending beyond the outer edge of the bottom end of said first cone wall, the extended surface defining a shelf member below the kiln chamber outlet, the shelf member being adapted to support the aggregate material during a downward movement of the aggregate material from the kiln chamber, through said outlet, and onto the shelf member;

a support member fastened to the wall of the second cone member, and positioned above the shelf member;

a driven gear supported by said support member, and positioned above the shelf member;

a driver gear which engages the driven gear;

a drive means operatively connected to the driver gear;

a means fastened to the driven gear, positioned above the shelf member, and adapted to travel above the shelf member in the same direction as the driven gear to continuously remove the downwardly moving aggregate material from the shelf member; and a collection means positioned below the shelf member, said collection means being adapted to collect the aggregate material removed from the shelf member.

2. The kiln apparatus of claim 1 wherein the aggregate removing means comprises at least one upright blade member, the blade being connected to one end of a leg member, the opposite end of the leg being connected to the driven gear, and the lower edge of the blade being positioned slightly above the shelf member.

3. The kiln apparatus of claim 1 in which the aggregate removing means comprises several upright blade members, each blade is connected to one end of a leg member, the opposite end of each leg is connected to the driven gear at equidistant points on said gear, and the lower edge of each blade is positioned slightly above the shelf member.

4. The kiln apparatus of claim 3 in which each blade member is set at an angle of from 30° to 50° from the perpendicular axis of the shelf member, the angle of set for each blade being toward the direction in which the blade travels above the shelf member.

5. The kiln apparatus of claim 1 in which the plate member is a circular plate member.

6. The kiln apparatus of claim 1 in which the wall of the first cone member has a downward slope angle which is at least 30° from perpendicular.

7. The kiln apparatus of claim 1 in which the wall of the second cone member has a downward slope angle which is at least 30° from perpendicular.

8. The apparatus of claim 1 in which the aggregate collection means is a hopper positioned below the shelf member.

* * * * *